US009855511B2

(12) United States Patent
Wicken et al.

(10) Patent No.: US 9,855,511 B2
(45) **Date of Patent: *Jan. 2, 2018**

(54) POLE COUPLING BALLOON SYSTEM

(71) Applicant: Balloon Innovations, Inc., Westminster, CO (US)

(72) Inventors: Christopher J. Wicken, Golden, CO (US); Gregg A. Wicken, Boulder, CO (US)

(73) Assignee: BALLOON INNOVATIONS, INC., Westminster, CO (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/093,393

(22) Filed: Apr. 7, 2016

(65) Prior Publication Data

US 2016/0214023 A1 Jul. 28, 2016

Related U.S. Application Data

(63) Continuation-in-part of application No. 14/831,759, filed on Aug. 20, 2015, now Pat. No. 9,314,706.

(60) Provisional application No. 62/039,737, filed on Aug. 20, 2014.

(51) Int. Cl.

| | |
|---|---|
| ***A63H 27/10*** | (2006.01) |
| *G09F 15/00* | (2006.01) |
| *A63H 33/26* | (2006.01) |

(52) U.S. Cl.

CPC ..... *A63H 27/10* (2013.01); *A63H 33/26* (2013.01); *A63H 2027/1008* (2013.01); *A63H 2027/1025* (2013.01); *A63H 2027/1033* (2013.01); *A63H 2027/1041* (2013.01); *A63H 2027/1075* (2013.01)

(58) Field of Classification Search

CPC ..... A63H 27/00; A63H 27/10; A63H 2027/1041; A63H 2027/1025; A63H 2027/1075; G09F 15/00; F16M 13/00; F16M 13/022

USPC ..... 446/69, 220–226; 248/201, 205.1, 218.4

See application file for complete search history.

(56) References Cited

U.S. PATENT DOCUMENTS

| | | | | |
|---|---|---|---|---|
| 4,944,709 A * | 7/1990 | Lovik | ..... | A63H 27/10 446/221 |
| 6,186,857 B1 * | 2/2001 | Gazit | ..... | G09F 15/0025 40/406 |
| 6,447,361 B1 * | 9/2002 | Akiyama | ..... | A63H 27/10 137/625.21 |

* cited by examiner

*Primary Examiner* — Kien Nguyen

(74) *Attorney, Agent, or Firm* — Berg Hill Greenleaf & Ruscitti LLC

(57) ABSTRACT

The invention includes methods and apparatus for bisected and/or partially bisected helium-free balloons that may be secured over an extended stationary structure such as an extended pole and/or lamp-post such that the secured balloon gives the appearance of being whole or un-bisected. Some embodiments may include an continuous and/or continuous air-fed balloon system. Additional embodiments include improved methods for elevating and/or coupling a bisected and/or partially bisected helium-free balloon an extended stationary structure such as an extended pole and/or lamp-post.

24 Claims, 5 Drawing Sheets

POLE COUPLING BALLOON SYSTEM

Figure 1A:
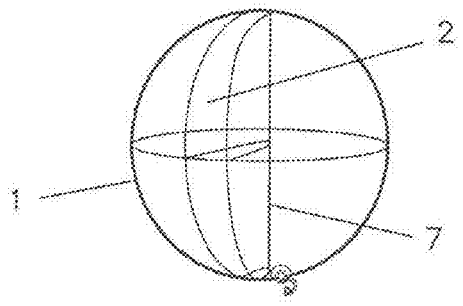
Figure 1B:
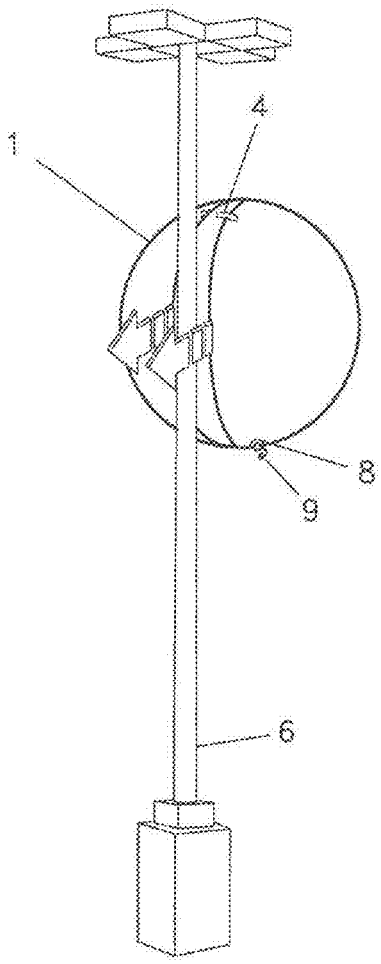
Figure 1C:
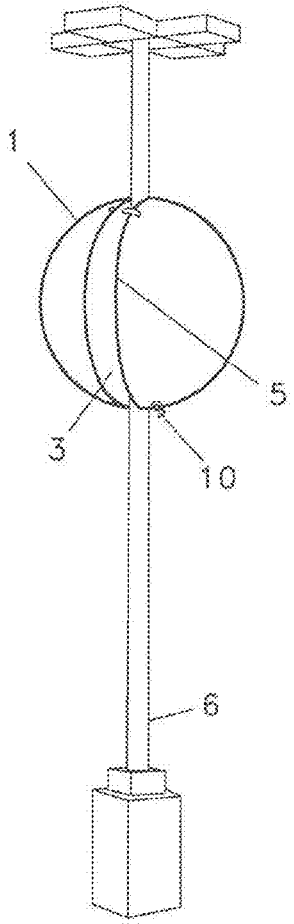
Figure 1D:
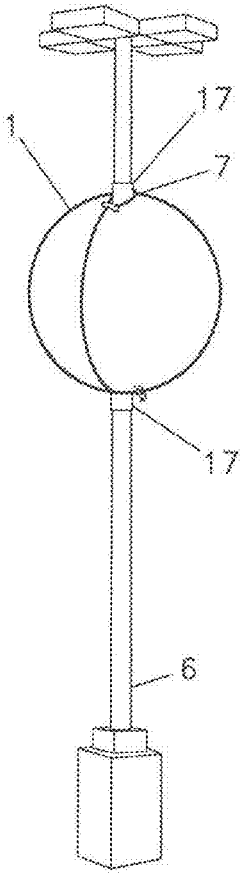

This U.S. Nonprovisional Application is a continuation-in-part, and claims priority to and the benefit of U.S. Nonprovisional application Ser. No. 14/831,759, filed Aug. 20, 2015, which claim claims priority to and the benefit of U.S. Provisional Application No. 62/039,737, filed Aug. 20, 2014, both of which are hereby incorporated by reference in their entirety.

TECHNICAL FIELD

Generally, the inventive technology disclosed herein relates to a novel system for the securement of a bisected and/or partially bisected balloon to a stationary element. More specifically, the inventive technology in one preferred embodiment may involve methods, apparatus, techniques, and systems for the creation of a bisected and/or partially bisected helium-free balloon that may be secured over an extended stationary element such as an extended pole and/or lamp-post such that the secured balloon gives the appearance of being whole or un-bisected. Some embodiments may include an air-fed balloon system. This inventive technology may be particularly suited for helium-free balloons and display systems that are positioned outside commercial establishments to attract attention and/or highlight a specific promotion or event.

BACKGROUND

Traditional external marketing devices are commonly employed to promote various commercial or organizational interests as well as events. For example, traditional external marketing devices may include some type of large object, such as signs, placards or novelty attention grabbing devices that may be placed outside to catch a passerby's attention thereby promoting a certain business or event. In recent years, various inflatable external devices have been deployed as marketing devices to attract public attention. Example of such air-filled based systems may include external balloon systems, as well as large inflatable figures or structures. Despite their use, such large inflatable devices have several drawbacks that limit their uses. First, traditional large inflatable devices are typically expensive and simply not cost effective for most businesses to purchase for a specific promotion or event. As a result, most traditional large inflatable devices must be rented for short periods of time. This fact also limits the ability to personalize any large inflatable devices for a specific event or promotion. Second, traditional helium-based large inflatable devices are not cost effective. For example, a lack of private sector helium producers, federal regulations and a decline in U.S. Federal Helium Reserves have resulted in significant price increases and dwindling supplies of commercially available helium. Much of the available helium gas is currently being diverted to industrial and/or medical uses, such as MRIs, cryogenic preservation, as well as scientific applications such as particle accelerators. Under these conditions, it is simply not cost effective to continue production of helium-dependent inflatable marketing systems.

Traditional external balloon displays may incorporate or be attached to physical structures. However, such traditional displays are also limited in their ability to serve as effective marketing attractants. For example, smaller external displays may require numerous balloons to be coupled together to form a display of sufficient size to be effectively seen by potential customers. Additionally, certain helium-free balloons may require specialized support apparatus to position the balloon at an elevated position. Further, certain environmental structures are configured so as to limit the ability of balloons to be coupled to such structures and displayed to potential consumers. For example, in this instance stationary poles, such as lamp-posts and the like may serve as anchor points to hold balloon displays. However, the shape of such poles restricts the ability of the balloon to be able to independently coupled with, and incorporate the pole as part of the display absent a secondary coupling or support device.

As can be seen, there is a need for a single comprehensive solution to the limitations described above. It is therefore the object of the present invention to provide a cost effective, helium-free inflatable device that can be secured in an elevated position to a stationary object and that will not require constant re-inflation through a dedicated air-pump. Moreover, such elevated balloon displays may be difficult to secure to elevated positions, for example on a light-pole. Traditional systems require a user to use a ladder or other elevating device to lift the user to a desired height to allow any display to be coupled to an elevated external structure. In addition, such elevated displays generally need to be accessible to allow re-inflation due to the gradual loss of air or other gasses through the balloon membrane. Such inflation and re-inflation steps, again, must generally be accomplished by using a ladder or other elevating device, or to bring the display to the ground to then be re-installed.

As can be seen, there is a need for a single comprehensive solution to the limitations described above. It is therefore the object of the present invention to provide a cost effective, inflatable device that can be secured in an elevated position to a stationary object and that will not require constant re-inflation through a dedicated air-pump. It is another goal of the current invention to provide an inflatable device that may be inflated, re-inflated and/or deflated while in an elevated position. Another goal of the current invention is to provide an inflatable device that may be coupled with an external structure, such as a stationary pole, at an elevated position while the installer or user remains on the ground. Accordingly, the objects of the methods and apparatus described herein address each of the aforementioned problems and goals in a practical manner. Naturally, further objects of the inventive technology will become apparent from the description and drawings below.

FIGURES

Figure 4A:
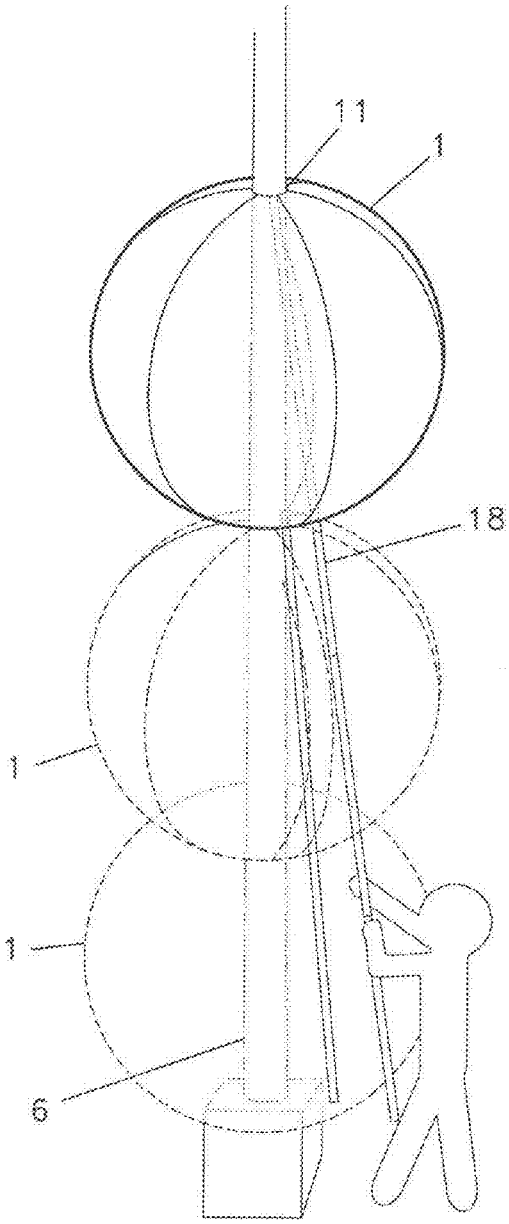
Figure 4B:
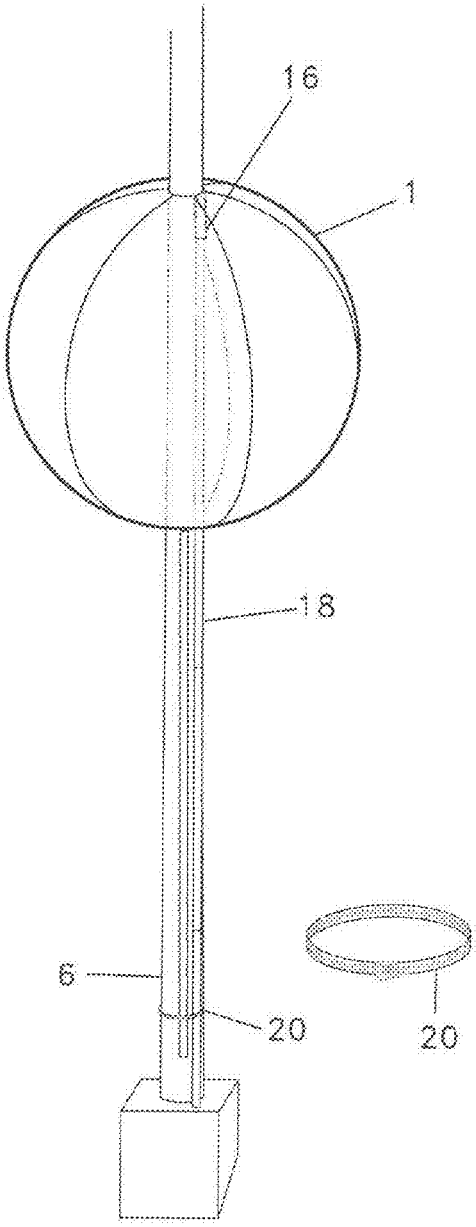
Figure 5A:
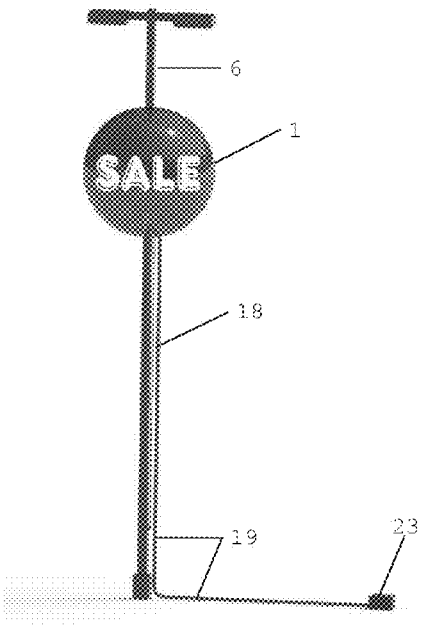
Figure 5B:
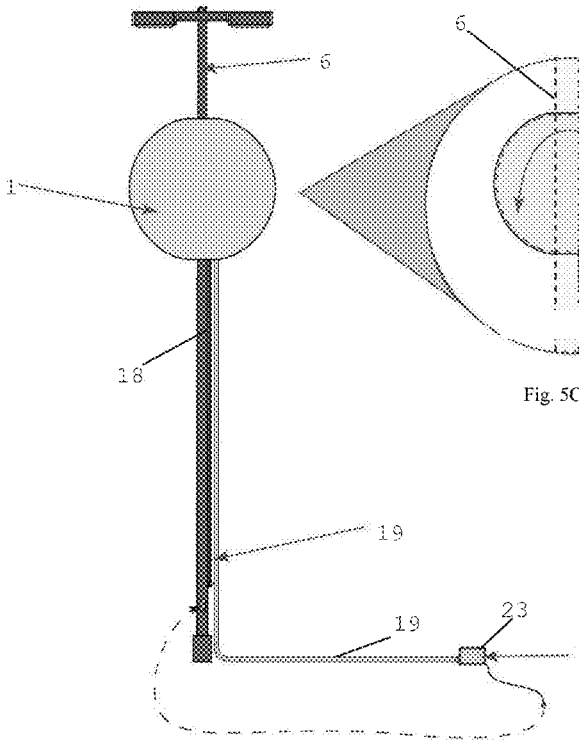
Figure 5C:
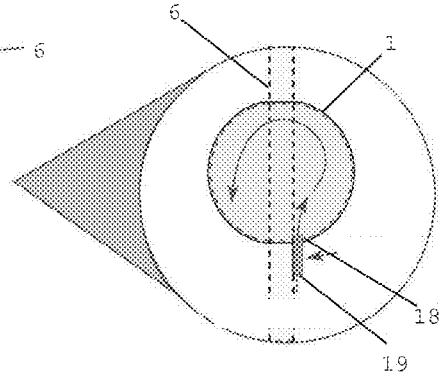

FIG. 1 A: is a partially bisected pole-attaching balloon in one embodiment thereof;

FIGS. 1 B-D: is a partially bisected pole-attaching balloon system coupled with a stationary pole in one embodiment thereof;

FIGS. 2 A-C: is a reinforced channel collar in one embodiment thereof;

FIG. 2 D: is a reinforced channel collar coupled with a reinforced strap positioned within a pole aperture in one embodiment thereof;

FIGS. 2 E-F: is a reinforced channel collar coupled with a reinforced strap having a pole support attachment in one embodiment thereof;

FIG. 3 A: is an exploded view of a partially bisected pole-attaching balloon having a plurality of balloon flaps and a bisected channel flap in one embodiment thereof;

FIG. 3 B: is an exploded view of an inflation port;

FIG. 3 C: is an exploded view of an inflation port having a valve;

FIG. 3 D: is a partially bisected pole-attaching balloon having an external cover in one embodiment thereof;

FIG. 3 E: is an exploded view of an external zipper element in one embodiment thereof;

FIG. 4 A: is a partially bisected pole-attaching balloon being elevated using a support pole in one embodiment thereof;

FIG. 4B: is a partially bisected pole-attaching balloon secured to a stationary pole by a support pole and having an inflation tube in one embodiment thereof; and FIG. 5A-C: are two front views and a blow-up cross sectional view of an air-fed pole-attaching balloon in one embodiment thereof.

DETAILED DESCRIPTION OF INVENTION

The present invention includes a variety of aspects, which may be combined in different ways. The following descriptions are provided to list elements and describe some of the embodiments of the present invention. These elements are listed with initial embodiments, however it should be understood that they may be combined in any manner and in any number to create additional embodiments. The variously described examples and preferred embodiments should not be construed to limit the present invention to only the explicitly described systems, techniques, and applications. Further, this description should be understood to support and encompass descriptions and claims of all the various embodiments, systems, techniques, methods, devices, and applications with any number of the disclosed elements, with each element alone, and also with any and all various permutations and combinations of all elements in this or any subsequent application.

Generally referring to FIGS. 1 A-D, in one embodiment, the inventive technology may include at least one bisected and/or partially-bisected balloon (1). In a preferred embodiment, such a partially bisected balloon may include a shaped helium-free balloon having a bisected opening (2) spanning, in this embodiment, along the circumference of the balloon surface from two polar positions. Such bisected opening (2) may form a continuous bisected channel (3) that may be secured over, for example, a stationary structure such as a stationary pole (6) or a lamp-post. In some embodiments this partially bisected balloon (1) may be formed through the seam welding of various balloon flaps (13) forming the desired shape and having the aforementioned bisected opening (2) and channel (3).

Figures 3A, 3B, 3C, 3D, 3E:
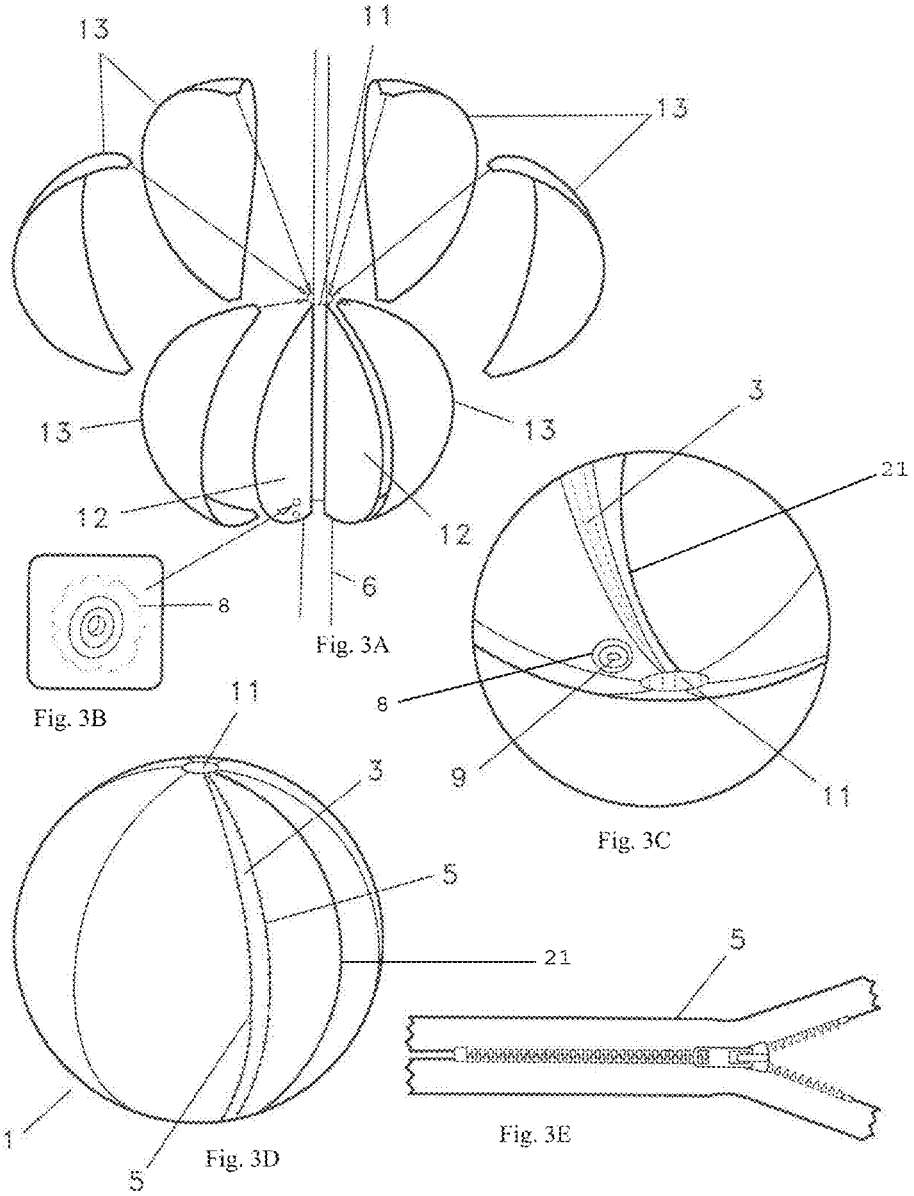

For example, as shown in FIG. 3A, in one embodiment one or more balloon flaps (13) may be secured, perhaps through seam or heat welding with at least one bisected channel flap (12). In this embodiment, the bisected channel flap (12) may form a bisected opening (2). In a preferred embodiment, this opening may be formed by a bisected channel flap (12) having a bisected channel (2), which may be integral with, or seam/heat welded to a bisected channel flap (12). As shown in FIG. 3A, such bisected channel flap (12) having a bisected channel (2) may be configured to be coupled with a pole or other stationary structure including non-pole like structures.

In another embodiment, a partially bisected balloon (1) may be formed through adhesives securing the various balloon flaps (13) forming the desired shape and having the aforementioned bisected opening (2) and bisected channel (3). In yet another embodiment, a bisected and/or partially bisected balloon (1) may be formed through continuous balloon formation techniques such as rotational molding (such as those specifically described in U.S. patent application: Ser. No. 14/201,665, incorporated in its entirety herein by reference) forming, for example, a seamless partially bisected balloon (1) having the aforementioned bisected opening (2) and/or bisected channel (3).

Referring again to FIGS. 1 A-D, in one embodiment, a partially bisected balloon (1) may include a securement element (4) that may be configured to secure said bisected opening (2) around said pole. In a preferred embodiment, this securement element (4) may include at least one external zipper element (5) that may be mated such that the external surface of said bisected opening (2) may be secured together closing the bisected opening (2). In this embodiment, a stationary pole may be positioned within the bisected channel (3) and secured by the securement element (4) closing the bisected opening (2). In the embodiment shown in FIG. 1D, this closure of the bisected opening (2) having a pole positioned within, or coupled with, the bisected channel (3) may secure one or more balloons to a stationary element, in this case a pole (6) or lamp-post (6). In a preferred embodiment, the internal pressure of the closed partially bisected balloon (1) may secure the balloon element to the stationary pole (6). In further embodiments, the securement element (4) may include one or more securement element(s) (4) selected from the group consisting of: a Velcro securement element; a button securement element; a snap securement element; a slide lock securement element; a connector securement element; a tie securement element; and/or an adhesive securement element and the like.

Moreover, in another embodiment shown in FIG. 3D, a partially bisected balloon (1) may include an external cover (21) that may be secured over a securement element (4), such as an external zipper (5) in a closed position. In a preferred embodiment, such an external cover (21) may include a flap that may be secured over a secured bisected opening (2) to provide the visual appearance of a continuous surface. In certain embodiments, this bisected opening cover may be secured over a secured bisected opening (2) through: a Velcro secured external cover; a button secured external cover; a snap secured external cover; a magnetic secured external cover; a slide lock secured external cover; a connector secured external cover; a tie secured external cover; and an adhesive secured external cover and the like. Additionally, in a preferred embodiment, an external cover may be seam-welded and/or rotationally molded, for example through the methods described in U.S. patent application Ser. No. 14/201,665, which is incorporated in its entirety herein by reference.

As noted above, the internal pressure of the bisected and/or partially bisected balloon (1) may create a pressure/friction connection with the underlying support structure, in this case a stationary pole (6), maintaining the coupled position of the balloon on the pole. In additional embodiments, the internal surface of the bisected channel (3) may include a high-friction surface (7) or even an adhesive surface that may form a friction and/or adhesive coupling that may more firmly secure the balloon element to, in this case a stationary pole, and prevent the pole from slipping downward, such as when the balloon may lose air-pressure over time or by through fluctuations in temperature. Such pole coupling may also prevent undesired twisting or rotation of the balloon along the axis of the pole.

Additional elements may be employed to further secure one or more bisected or partially bisected balloon elements (1) to a pole. For example, in one embodiment, said bisected or partially bisected balloon element (1) may be secured to a stationary element, such as a pole (6), through one or more pole couplers (17). In a preferred embodiment, one or more pole couplers (17) may be secured to a bisected or partially balloon element (1) and then secured to a pole. For example, one or more magnetic couplers may be secured to a balloon, perhaps through a latch or fitted attachment, or even a pre-configured slot within or along the internal surface of the bisected channel (3) or other structure. Such a coupler may then be secured to a pole (6) so as to help support the balloon structure in an elevated position on the pole (6). Naturally, such embodiment is only exemplary as a variety of couplers and/or connects may be utilized such as: a clamp coupler; a pressure coupler; a slide coupler; a tie coupler; an adhesive coupler; a slide lock coupler; and a hook coupler. In certain other embodiments, a connector element may be secured to a stationery element, such as a pole, at a desired location which may be further mated to another connector element secured to a bisected balloon element (1). In a preferred embodiment, such connector(s) may be positioned externally on a balloon surface or internally, for example inside a bisected channel (3).

Again, as noted above, the current inventive technology does not require constant supply of air to remain inflated. Indeed, in a preferred embodiment, the invention contemplates a helium-free bisected and/or partially bisected balloon system. Referring to FIG. 1, in one embodiment, a partially bisected balloon (1) may include at least one inflation port (8) which may further secure a valve (9), such as a one-way valve allowing manual or mechanical inflation of said balloon. Such valve housing may, in some embodiments, include a valve plug (10), which may or may not be integral with the inflation port (8) or valve (9).

In still further embodiments, a bisected or partially-bisected balloon (1) may include one or more of the following: a polyvinyl chloride (PVC) helium-free balloon; an elastomeric helium-free balloon; a plastic helium-free balloon; a polyurethane (PU) helium-free balloon; a thermoplastic polyurethane helium-free balloon; a low-density polyethylene helium-free balloon; a linear-low-density polyethylene helium-free balloon; a high-density polyethylene helium-free balloon; a cross linked grade polyethylene helium-free balloon; an ethylene vinyl acetate helium-free balloon; a plasticine helium-free balloon; an adhesive-type polyethylene helium-free balloon; a polyvinyl chloride helium-free balloon; a nylon helium-free balloon; a polycarbonate helium-free balloon; a polyester helium-free balloon; a polypropylene helium-free balloon; a seam-welded helium-free balloon and a rotationally molded seam-welded helium-free balloon.

While the partially-bisected balloon (1) as shown in FIG. 1 is round, it should be noted that any number of personalized configurations are contemplated in the inventive technology and should not be considered limiting. Additionally, in certain embodiments, personalized information such a logos or slogans or even a business name of event identifier may be integrated into a balloon surface. In this respect, the elevated position of a secured balloon may more effectively attract consumer attention.

Generally referring now to FIGS. 2A-F, in one embodiment the inventive technology may include a reinforced channel collar (14). In a preferred embodiment shown in FIGS. 2 A-C, a portion of material, such as PVC or TPU may be shaped to form a reinforced channel collar (14). In this embodiment, a portion of material, such as PVC or TPU may be cut and seam-welded together to form a central pocket (22) with two or more arms that extend in a circular fashion. In certain embodiments, one or more reinforced channel collars (14) may be placed within a pole aperture (11) at either, or both poles of the balloon. In other embodiments, one or more reinforced channel collars (14) may be positioned along the length of a bisected channel (3). The internal surface of the reinforced channel collar (14) may include a friction and/or adhesive surface as described generally above. In another preferred embodiment, a reinforced channel collar (14) may include a pole support attachment (16). In this embodiment, a pole support attachment (16) may accommodate and/or secure a support pole (18) that may, as generally shown in FIGS. 4A-B, be used to raise and/or support an elevated balloon structure. In one embodiment, a reinforced channel collar (14) may be coupled with a pole coupler (17), which may then be coupled with a pole (6) securing the balloon into an elevated position.

Figure 2A:
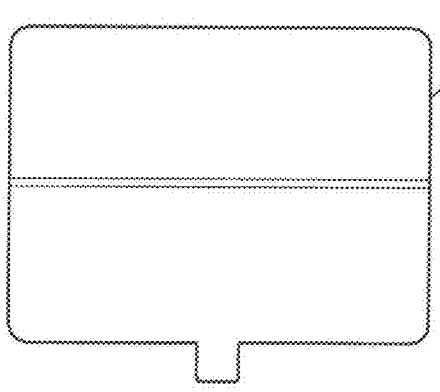
Figure 2B:
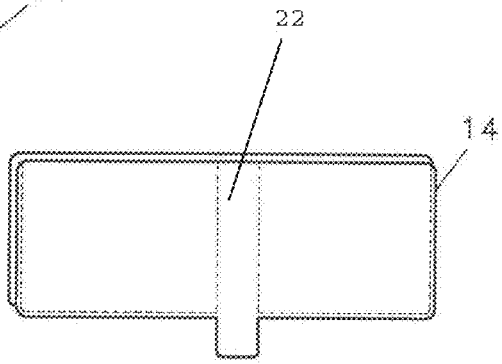
Figure 2C:
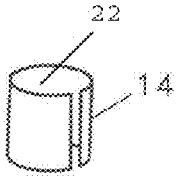
Figure 2D:
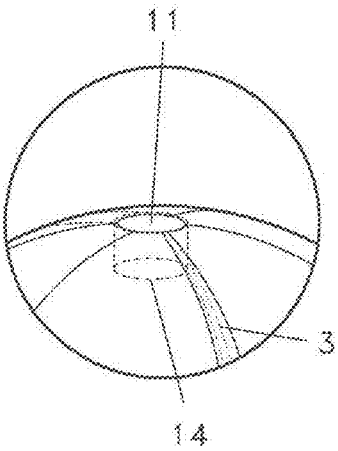
Figure 2E:
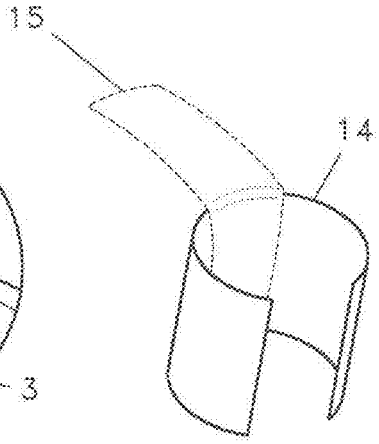
Figure 2F:
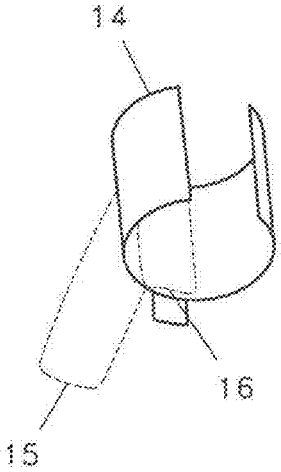

Referring now to FIGS. 2D-F, in one embodiment a reinforced strap (15) may be coupled with a reinforced channel collar (14). In a preferred embodiment, a reinforced strap (15) may be seam- or heat-welded to a reinforced channel collar (14). In this preferred embodiment, the coupled reinforced strap (15) and reinforced channel collar (14) may be positioned within a pole aperture (11) with a portion of the reinforced strap (15) secured, again perhaps through seam- or heat-welding to the external or internal surface of the balloon. In this embodiment, a space may exist between the reinforced strap (15) and the reinforced channel collar (14) which may form a pole support attachment (16). In this embodiment, a pole support attachment (16) may accommodate and/or secure a support pole (18) that may, as generally shown in FIGS. 4A-B, be used to raise and/or support an elevated balloon structure. In other embodiments, a bisected and/or partially-bisected balloon (1) may include one or more pole support attachment (16) positions and may accommodate and/or secure a support pole (18).

In one preferred embodiment one or more bisected and/or partially bisected balloon elements (1) may be secured to, in this case, a stationary pole (6) in an uninflated condition either at a desired elevation or standard user's height. In another embodiment, one or more bisected and/or partially bisected balloon elements (1) may be secured to, in this case, a stationary pole (6) in an inflated condition either at a desired elevation or standard user's height. In both cases, where the balloon element is attached, for example, at the bottom of the pole, it may be extended upward manually, or as described above through an extendable pole. In this embodiment, the partially bisected balloon elements (1) may include pole support attachment (16) that may include a hard plastic slot, attachment element or other suitable structure that may be coupled with an support pole (18). In this embodiment, a user may raise or lower a balloon element along the length of a stationary or even temporary element such as a lamp-post.

Again referring to FIGS. 4A-B, in a preferred embodiment, a support pole (18) may be positioned with a pole support attachment (16). Such attachment position may be part of the balloon structure itself, or even part of a reinforced channel collar (14), reinforced strap (15) or even pole coupler (17). In a preferred embodiment, a support pole (18) may be positioned with a pole support attachment (16) formed by a coupled reinforced channel collar (14) and reinforced strap (15). This pole support attachment (16) may be positioned at a balloon's top pole allowing a user to raise and/or lower the balloon to a desired height while remaining on the ground. Again, as shown in figure B, in a preferred embodiment, the support pole (18) may be secured to a pole support attachment (16) and raised to a desired height then placed adjacent to the stationary pole (6) and further secured to the pole (6) by a clamp (20) or other suitable device. In this embodiment, the support pole (18) may act as a pole coupler (17) or balloon support, maintaining the position of the balloon on the pole (6). In another embodiment, one or more pole couplers (17) may couple the balloon pole, which may then be raised to a desired height through the action of the support pole (18). In this embodiment, the support pole (18) may be secured to the pole (6) as described above, or removed allowing the pole coupler(s) (17) to support the weight of the elevated balloon.

In another embodiment, an inflation tube (19) may be secured to an inflation port (8) allowing, for example, a user to inflate the balloon while it is secured in an elevated position. Such a tube element may be secured to the stationary structure, such as a pole (6), through a clamp (20) or strap or other appropriate securement connector and positioned in such a manner so as to be largely hidden from public view. In addition, such inflation valve may be segmented such that a portion of the tube may be removed to avoid potential theft or tampering. In addition, a support pole (6) may also be segmented such that a portion of the pole may be removed to avoid potential theft or tampering.

As generally shown in FIG. 5, in certain embodiment a bisected pole attaching balloon, which may include either a partially and/or fully bisected balloon (1), may include an air-fed pole attaching balloon. In his embodiment, an air blower (23) may be coupled with an inflation tube (19) and provide a continuous, or semi-continuous flow of air through the inflation tube (19) and into one or more one bisected and/or partially-bisected balloons (1). In some embodiments the air blower (23) may draw power from electrical outlets positioned on the pole (6), while in other embodiment such an air blower (23) may, for example be power by alternative means such as solar panel and the like.

In the embodiment shown in FIG. 5, the balloon (1) is coupled to the pole (6), and may further be maintained in that position through the use of support pole (18) as previously described. In other embodiment, one or more balloons (1) may be attached to a coupler which may be attached to a pole. Such coupled balloons may be air-fed by an air blower as herein described (23). In other embodiments, one or more balloon (1) may be slidably coupled with a pole (6), such that when the air blower (23) inputs air into a balloon (1), it may rise up the length of a pole (6), or other surface, as a result of the upward force of the air against the interior surface of the balloon (1). Such embodiments may include rollers, or slidable couplers which may facilitate the balloons traversing the length of the pole.

Naturally, all embodiments discussed herein are merely illustrative and should not be construed to limit the scope of the inventive technology consistent with the broader inventive principles disclosed. As may be easily understood from the foregoing, the basic concepts of the present inventive technology may be embodied in a variety of ways. It generally involves systems, methods, techniques as well as devices to accomplish a pole coupling balloon system and the like. In this application, the methods and apparatus for the aforementioned systems are disclosed as part of the results shown to be achieved by the various devices described and as steps which are inherent to utilization. They are simply the natural result of utilizing the devices as intended and described. In addition, while some devices are disclosed, it should be understood that these not only accomplish certain methods but also can be varied in a number of ways. Importantly, as to all of the foregoing, all of these facets should be understood to be encompassed by this disclosure.

While the invention has been described in connection with a preferred embodiment, it is not intended to limit the scope of the invention to the particular form set forth, but on the contrary, it is intended to cover such alternatives, modifications, and equivalents as may be included within the spirit and scope of the invention as defined by the statements of invention. As can be easily understood from the foregoing, the basic concepts of the present invention may be embodied in a variety of ways. It involves both techniques as well as devices to accomplish the appropriate system. In this application, the techniques are disclosed as part of the results shown to be achieved by the various devices described and as steps which are inherent to utilization. They are simply the natural result of utilizing the devices as intended and described. In addition, while some devices are disclosed, it should be understood that these not only accomplish certain methods but also can be varied in a number of ways. Importantly, as to all of the foregoing, all of these facets should be understood to be encompassed by this disclosure.

The discussion included in this application is intended to serve as a basic description. The reader should be aware that the specific discussion may not explicitly describe all embodiments possible; many alternatives are implicit. It also may not fully explain the generic nature of the invention and may not explicitly show how each feature or element can actually be representative of a broader function or of a great variety of alternative or equivalent elements. Again, these are implicitly included in this disclosure. Where the invention is described in method-oriented terminology, each element of the claims corresponds to a device. Apparatus claims may not only be included for the device described, but also method or process claims may be included to address the functions the invention and each element performs. Neither the description nor the terminology is intended to limit the scope of the claims that will be included in any subsequent patent application.

It should also be understood that a variety of changes may be made without departing from the essence of the invention. Such changes are also implicitly included in the description. They still fall within the scope of this invention. A broad disclosure encompassing both the explicit embodiment(s) shown, the great variety of implicit alternative embodiments, and the broad methods or processes and the like are encompassed by this disclosure and may be relied upon when drafting any claims. It should be understood that such language changes and broader or more detailed claiming may be accomplished at a later date (such as by any required deadline) or in the event the applicant subsequently seeks a patent filing based on this filing. With this understanding, the reader should be aware that this disclosure is to be understood to support any subsequently filed patent application that may seek examination of as broad a base of claims as deemed within the applicant's right and may be designed to yield a patent covering numerous aspects of the invention both independently and as an overall system.

Further, each of the various elements of the invention and claims may also be achieved in a variety of manners. Additionally, when used or implied, an element is to be understood as encompassing individual as well as plural structures that may or may not be physically connected. This disclosure should be understood to encompass each such variation, be it a variation of an embodiment of any apparatus embodiment, a method or process embodiment, or even merely a variation of any element of these. Particularly, it should be understood that as the disclosure relates to elements of the invention, the words for each element may be expressed by equivalent apparatus terms or method terms—even if only the function or result is the same. Such equivalent, broader, or even more generic terms should be considered to be encompassed in the description of each element or action. Such terms can be substituted where desired to make explicit the implicitly broad coverage to which this invention is entitled. As but one example, it should be understood that all actions may be expressed as a means for taking that action or as an element which causes that action. Similarly, each physical element disclosed should be understood to encompass a disclosure of the action which that physical element facilitates. Regarding this last aspect, as but one example, the disclosure of a "coupler" should be understood to encompass disclosure of the act of "coupling"—whether explicitly discussed or not—and, conversely, were there effectively disclosure of the act of "coupling", such a disclosure should be understood to encompass disclosure of a "coupling method and/or technique, and/or device" and even a "means for coupling." Such changes and alternative terms are to be understood to be explicitly included in the description.

Any patents, publications, or other references mentioned in this application for patent, such as in the specification or an IDS are hereby incorporated herein by reference in their entirety. Any priority case(s) claimed by this application is hereby appended and hereby incorporated herein by reference in their entirety. In addition, as to each term used it should be understood that unless its utilization in this application is inconsistent with a broadly supporting interpretation, common dictionary definitions should be understood as incorporated for each term and all definitions, alternative terms, and synonyms such as contained in the Random House Webster's Unabridged Dictionary, second edition are hereby incorporated herein by reference in their entirety. Finally, all references listed in the list of References To Be Incorporated By Reference In Accordance With The Patent Application or other information disclosure statement and the like filed with the application are hereby appended and hereby incorporated herein by reference in their entirety, however, as to each of the above, to the extent that such information or statements incorporated by reference might be considered inconsistent with the patenting of this/these invention(s) such statements are expressly not to be considered as made by the applicant(s).

Thus, the applicant(s) should be understood to have support to claim and make a statement of invention to at least: i) each of the methods and/or apparatus for providing a pole coupling balloon system as herein disclosed and described, ii) the related methods disclosed and described, iii) similar, equivalent, and even implicit variations of each of these devices and methods, iv) those alternative designs which accomplish each of the functions shown as are disclosed and described, v) those alternative designs and methods which accomplish each of the functions shown as are implicit to accomplish that which is disclosed and described, vi) each feature, component, and step shown as separate and independent inventions, vii) the applications enhanced by the various systems or components disclosed, viii) the resulting products produced by such systems or components, ix) each system, method, and element shown or described as now applied to any specific field or devices mentioned, x) methods and apparatuses substantially as described hereinbefore and with reference to any of the accompanying examples, xi) the various combinations and permutations of each of the elements disclosed, xii) each potentially dependent claim or concept as a dependency on each and every one of the independent claims or concepts presented, and xiii) all inventions described herein.

With regard to claims whether now or later presented for examination, it should be understood that for practical reasons and so as to avoid great expansion of the examination burden, the applicant may at any time present only initial claims or perhaps only initial claims with only initial dependencies. The office and any third persons interested in potential scope of this or subsequent applications should understand that broader claims may be presented at a later date in this case, in a case claiming the benefit of this case, or in any continuation in spite of any preliminary amendments, other amendments, claim language, or arguments presented, thus throughout the pendency of any case there is no intention to disclaim or surrender any potential subject matter. It should be understood that if or when broader claims are presented, such may require that any relevant prior art that may have been considered at any prior time may need to be re-visited since it is possible that to the extent any amendments, claim language, or arguments presented in this or any subsequent application are considered as made to avoid such prior art, such reasons may be eliminated by later presented claims or the like. Both the examiner and any person otherwise interested in existing or later potential coverage, or considering if there has at any time been any possibility of an indication of disclaimer or surrender of potential coverage, should be aware that no such surrender or disclaimer is ever intended or ever exists in this or any subsequent application. Limitations such as arose in Hakim v. Cannon Avent Group, PLC, 479 F.3d 1313 (Fed. Cir 2007), or the like are expressly not intended in this or any subsequent related matter. In addition, support should be understood to exist to the degree required under new matter laws—including but not limited to European Patent Convention Article 123(2) and United States Patent Law 35 USC 132 or other such laws—to permit the addition of any of the various dependencies or other elements presented under one independent claim or concept as dependencies or elements under any other independent claim or concept. In drafting any claims at any time whether in this application or in any subsequent application, it should also be understood that the applicant has intended to capture as full and broad a scope of coverage as legally available. To the extent that insubstantial substitutes are made, to the extent that the applicant did not in fact draft any claim so as to literally encompass any particular embodiment, and to the extent otherwise applicable, the applicant should not be understood to have in any way intended to or actually relinquished such coverage as the applicant simply may not have been able to anticipate all eventualities; one skilled in the art, should not be reasonably expected to have drafted a claim that would have literally encompassed such alternative embodiments.

Further, if or when used, the use of the transitional phrase "comprising" is used to maintain the "open-end" claims herein, according to traditional claim interpretation. Thus, unless the context requires otherwise, it should be understood that the term "comprise" or variations such as "comprises" or "comprising", are intended to imply the inclusion of a stated element or step or group of elements or steps but not the exclusion of any other element or step or group of elements or steps. Such terms should be interpreted in their most expansive form so as to afford the applicant the broadest coverage legally permissible. It should be understood that this application also provides support for any combination of elements in the claims and even incorporates any desired proper antecedent basis for certain claim combinations such as with combinations of method, apparatus, process, and the like claims.

Finally, any claims set forth at any time are hereby incorporated by reference as part of this description of the invention, and the applicant expressly reserves the right to use all of or a portion of such incorporated content of such claims as additional description to support any of or all of the claims or any element or component thereof, and the applicant further expressly reserves the right to move any portion of or all of the incorporated content of such claims or any element or component thereof from the description into the claims or vice-versa as necessary to define the matter for which protection is sought by this application or by any subsequent continuation, division, or continuation-in-part application thereof, or to obtain any benefit of, reduction in fees pursuant to, or to comply with the patent laws, rules, or regulations of any country or treaty, and such content incorporated by reference shall survive during the entire pendency of this application including any subsequent continuation, division, or continuation-in-part application thereof or any reissue or extension thereon. The inventive subject matter is to include, but certainly not be limited as, a system substantially as herein described with reference to any one or more of the Figures and Description (including the following: for example, the process according to any claims and further comprising any of the steps as shown in any Figures, separately, in any combination or permutation).

What is claimed is:

1. An elevatable pole-attaching balloon system comprising:

a balloon having a bisected opening formed by a bisected channel flap having a bisected channel configured to be coupled with a pole;

at least one securement element configured to secure said bisected opening around said pole;

at least one reinforcement strap having a pole support attachment coupled with said balloon;

at least one support pole configured to be positioned within said pole support attachment; and at least one inflation port on said balloon.

2. An elevatable pole-attaching balloon system as described in claim 1 and further comprising an inflation tube coupled with said inflation port on said balloon.

3. An elevatable pole-attaching balloon system as described in claim 2 wherein said inflation tube is coupled with an air blower.

4. An elevatable pole-attaching balloon system as described in claim 1 wherein said balloon comprises a balloon selected from the group consisting of: fully bisected balloon; partially bisected balloon; a polyvinyl chloride (PVC) partially bisected helium-free balloon; an elastomeric partially bisected helium-free balloon; a plastic partially bisected helium-free balloon; a polyurethane (PU) partially bisected helium-free balloon; a thermoplastic polyurethane partially bisected helium-free balloon; a low-density polyethylene partially bisected helium-free balloon; a linear-low-density polyethylene partially bisected helium-free balloon; a high-density polyethylene partially bisected helium-free balloon; a cross linked grade polyethylene partially bisected helium-free balloon; an ethylene vinyl acetate partially bisected helium-free balloon; a plasticine partially bisected helium-free balloon; an adhesive-type polyethylene partially bisected helium-free balloon; a polyvinyl chloride partially bisected helium-free balloon; a nylon partially bisected helium-free balloon; a polycarbonate partially bisected helium-free balloon; a polyester partially bisected helium-free balloon; a polypropylene partially bisected helium-free balloon; a seam-welded partially bisected helium-free balloon and a rotationally molded partially bisected seam-welded helium-free balloon.

5. A reinforced partially bisected pole-attaching balloon system comprising:

a partially bisected balloon having a bisected opening formed by a bisected channel flap having a bisected channel configured to be coupled with a pole;

at least one securement element configured to secure said bisected opening around said pole;

at least one balloon aperture;

at least one reinforced channel collar positioned within said balloon aperture;

at least one pole coupler configured to support said partially bisected balloon; and at least one inflation port on said partially bisected balloon.

6. A reinforced partially bisected pole-attaching balloon system as described in claim 5 and further comprising an inflation tube coupled with said inflation port on said balloon.

7. A reinforced partially bisected pole-attaching balloon system as described in claim 6 wherein said inflation tube is coupled with an air blower.

8. A reinforced partially bisected pole-attaching balloon system as described in claim 5 wherein said partially bisected balloon comprises a balloon selected from the group consisting of: fully bisected balloon; a polyvinyl chloride (PVC) partially bisected helium-free balloon; an elastomeric partially bisected helium-free balloon; a plastic partially bisected helium-free balloon; a polyurethane (PU) partially bisected helium-free balloon; a thermoplastic polyurethane partially bisected helium-free balloon; a low-density polyethylene partially bisected helium-free balloon; a linear-low-density polyethylene partially bisected helium-free balloon; a high-density polyethylene partially bisected helium-free balloon; a cross linked grade polyethylene partially bisected helium-free balloon; an ethylene vinyl acetate partially bisected helium-free balloon; a plasticine partially bisected helium-free balloon; an adhesive-type polyethylene partially bisected helium-free balloon; a polyvinyl chloride partially bisected helium-free balloon; a nylon partially bisected helium-free balloon; a polycarbonate partially bisected helium-free balloon; a polyester partially bisected helium-free balloon; a polypropylene partially bisected helium-free balloon; a seam-welded partially bisected helium-free balloon and a rotationally molded partially bisected seam-welded helium-free balloon.

9. A bisected balloon comprising:

a helium-free balloon having at least one bisected opening;

at least one bisected channel configured to be slidably coupled around the circumference of at least one pole such that said balloon having at least one bisected opening may slide along the length of said pole and where the distal ends of said bisected channel are configured to be capable of sliding over the bottom or top terminal ends of said pole; and at least one inflation port on said bisected balloon.

10. A bisected balloon as described in claim 9 and further comprising an inflation tube coupled with said balloon.

11. A bisected balloon as described in claim 10 wherein said inflation tube is coupled with an air blower.

12. A bisected balloon as described in claim 9 and further comprising at least one securement element configured to secure said bisected opening around said pole.

13. A bisected balloon as described in claim 12 wherein said securement element comprises a securement element selected from the group consisting of: a Velcro securement element; a button securement element; a snap securement element; a slide lock securement element; a connector securement element; a tie securement element; and an adhesive securement element.

14. A bisected balloon as described in claim 9 wherein said bisected channel comprises a bisected channel selected from the group consisting of: a bisected channel having a high friction internal surface; and a bisected channel having an adhesive surface.

15. A bisected balloon as described in claim 9 and further comprising at least one pole coupler.

16. A bisected balloon as described in claim 15 wherein said pole coupler comprises a pole coupler selected from the group consisting of: a clamp coupler; a support pole; a magnetic coupler, a pressure coupler; a slide coupler; a tie coupler; an adhesive coupler; a slide lock coupler; and a hook coupler.

17. A bisected balloon as described in claim 9 and further comprising at least one pole support attachment.

18. A bisected balloon as described in claim 9 wherein said balloon is a fully bisected balloon.

19. A bisected balloon as described in claim 9 wherein said bisected balloon comprises a balloon selected from the group consisting of: a partially bisected balloon; a polyvinyl chloride (PVC) partially bisected helium-free balloon; an elastomeric partially bisected helium-free balloon; a plastic partially bisected helium-free balloon; a polyurethane (PU) partially bisected helium-free balloon; a thermoplastic polyurethane partially bisected helium-free balloon; a low-density polyethylene partially bisected helium-free balloon; a linear-low-density polyethylene partially bisected helium-free balloon; a high-density polyethylene partially bisected helium-free balloon; a cross linked grade polyethylene partially bisected helium-free balloon; an ethylene vinyl acetate partially bisected helium-free balloon; a plasticine partially bisected helium-free balloon; an adhesive-type polyethylene partially bisected helium-free balloon; a polyvinyl chloride partially bisected helium-free balloon; a nylon partially bisected helium-free balloon; a polycarbonate partially bisected helium-free balloon; a polyester partially bisected helium-free balloon; a polypropylene partially bisected helium-free balloon; a seam-welded partially bisected helium-free balloon and a rotationally molded partially bisected seam-welded helium-free balloon.

20. An air-fed partially bisected balloon comprising:

a partially bisected helium-free balloon having at least one bisected opening;

at least one bisected channel configured to be slidably coupled around the circumference of at least one pole such that said partially bisected balloon having at least one bisected opening may slide along the length of said pole and where the distal ends of said bisected channel are configured to be capable of sliding over the bottom or top terminal ends of said pole;

at least one inflation port on said partially bisected balloon;

at least one inflation tube coupled with said partially bisected balloon;

at least one air blower coupled with said inflation tube and configured to blow air through said inflation tube and inflate said partially bisected balloon.

21. An air-fed partially bisected balloon as described in claim 20 and further comprising at least one securement element configured to secure said partially bisected opening around said pole.

22. An air-fed partially bisected balloon as described in claim 20 and further comprising at least one pole coupler.

23. An air-fed partially bisected balloon as described in claim 20 wherein said balloon is a fully bisected balloon.

24. An air-fed partially bisected balloon as described in claim 20 wherein said partially bisected balloon comprises a balloon selected from the group consisting of: a bisected balloon; a polyvinyl chloride (PVC) partially bisected helium-free balloon; an elastomeric partially bisected helium-free balloon; a plastic partially bisected helium-free balloon; a polyurethane (PU) partially bisected helium-free balloon; a thermoplastic polyurethane partially bisected helium-free balloon; a low-density polyethylene partially bisected helium-free balloon; a linear-low-density polyethylene partially bisected helium-free balloon; a high-density polyethylene partially bisected helium-free balloon; a cross linked grade polyethylene partially bisected helium-free balloon; an ethylene vinyl acetate partially bisected helium-free balloon; a plasticine partially bisected helium-free balloon; an adhesive-type polyethylene partially bisected helium-free balloon; a polyvinyl chloride partially bisected helium-free balloon; a nylon partially bisected helium-free balloon; a polycarbonate partially bisected helium-free balloon; a polyester partially bisected helium-free balloon; a polypropylene partially bisected helium-free balloon; a seam-welded partially bisected helium-free balloon and a rotationally molded partially bisected seam-welded helium-free balloon.

* * * * *